US011033906B2

(12) United States Patent
Chang

(10) Patent No.: US 11,033,906 B2
(45) **Date of Patent: *Jun. 15, 2021**

(54) INTERCHANGEABLE CARTRIDGE-BASED PAPER SHREDDER SYSTEM

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/947,872

(22) Filed: Nov. 20, 2015

(65) Prior Publication Data

US 2016/0074869 A1 Mar. 17, 2016

Related U.S. Application Data

(63) Continuation of application No. 13/767,842, filed on Feb. 14, 2013, now Pat. No. 9,192,937.

(60) Provisional application No. 61/763,898, filed on Feb. 12, 2013.

(30) Foreign Application Priority Data

Feb. 14, 2012 (CN) ..... 201210032230.7
Feb. 14, 2012 (CN) ..... 201220046737.3

(51) Int. Cl.
*B02C 18/00* (2006.01)

(52) U.S. Cl.
CPC .. *B02C 18/0007* (2013.01); *B02C 2018/0038* (2013.01); *B02C 2018/0046* (2013.01)

(58) Field of Classification Search
CPC ..... B02C 18/0007; B02C 18/142; B02C 4/28; B02C 13/282; B02C 2018/0046; B02C 2018/0038
USPC ..... 241/100, 236, 285.2
See application file for complete search history.

(56) References Cited

U.S. PATENT DOCUMENTS

| | | | | |
|---|---|---|---|---|
| 5,016,828 | A | 5/1991 | Utsumi et al. | |
| 5,134,013 | A | 7/1992 | Parker | |
| 6,089,482 | A | 7/2000 | Chang | |
| 7,584,912 | B1 * | 9/2009 | Jiang | B02C 18/0007 241/100 |
| 9,027,862 | B2 | 5/2015 | Huang | |
| 2004/0262436 | A1 * | 12/2004 | Lo | B02C 18/0007 241/236 |
| 2006/0038048 | A1 * | 2/2006 | Lo | B02C 18/0007 241/100 |
| 2007/0164139 | A1 * | 7/2007 | Lipowski | B02C 18/24 241/101.2 |
| 2008/0099590 | A1 * | 5/2008 | Matlin | B02C 18/0007 241/36 |
| 2010/0213300 | A1 * | 8/2010 | Matlin | B02C 18/0007 241/285.1 |

* cited by examiner

*Primary Examiner* — Faye Francis
(74) *Attorney, Agent, or Firm* — Stefan J. Kirchanski; Matthew J. Spark; Zuber Lawler LLP

(57) ABSTRACT

A paper shredder is configured like a conventional paper shredder except that the shredding mechanism is located in a removable cartridge. This allows a single paper shredder housing to be rapidly converted from one shredding pattern to another by simply changing the shredding cartridge. Furthermore, shredding cartridges can be readily replaced whenever the shredding mechanism jams or fails in some other manner. This simplifies repair and servicing of the paper shredder.

4 Claims, 9 Drawing Sheets

INTERCHANGEABLE CARTRIDGE-BASED PAPER SHREDDER SYSTEM

CROSS-REFERENCE TO PRIOR APPLICATIONS

This application is a continuation of U.S. patent application Ser. No. 13/767,842, now U.S. Pat. No. 9,192,937, filed on Feb. 14, 2013 which claimed benefit of U.S. Provisional Patent Application No. 61/763,898, filed on Feb. 12, 2013 and which also claimed priority from CN 2012 1 0032230 and CN 2012 2 0046737 both filed on Feb. 14, 2012.

U.S. GOVERNMENT SUPPORT

Not Applicable

BACKGROUND OF THE INVENTION

Area of the Art

The current invention is in the area of paper shredders and is more specifically directed to paper shredders that have interchangeable shredding cartridges.

DESCRIPTION OF THE BACKGROUND

In spite of supposedly becoming a "paperless society" paper shredders remain an important item for ensuring security. In fact, the widespread use of the Internet to conduct all manner of business and financial affairs makes the inadvertent disclosure of even a single account number potentially disastrous. Because all manner of receipts and bills continue to disclose complete account numbers, it is imperative that one destroy this information prior to discarding the documents. In addition, many paper shredders will also shred credit cards and optical disks so as to further increase security. Specialized businesses such as pharmacies have the additional problem of destroying medication labels that could reveal confidential patient data. Therefore, the paper shredder remains the most effective way of ensuring that discarded documents, labels and cards do not reveal any personal information.

Although paper shredders have "evolved" quite a bit over the last few decades, the general details of their operation have remained fairly constant. In the most common type of paper shredder, documents to be destroyed are fed into a slot or input chute. Within the shredder a series of rotating cutting blades are spaced along a drive shaft. The inserted document meets these blades and is cut into innumerable pieces which fall from the shredding mechanism into a waste storage container or bin. What has evolved over time is the pattern of the paper pieces produced by the shredder. Early paper shredders cut the paper only into long strips rather like excelsior packing material. If the documents do not contain extremely critical information, such as social security numbers, this type of shredding may be adequate because the work to piece together the strips to recreate long and complex texts provides adequate protection to such texts. Further, shredders cutting long strips are often faster and somewhat less likely to jam. However, most modern shredders are "cross-cut" shredders that reduce the paper into confetti like fragments in the range of five millimeters in each dimension (i.e., an area of about 25 $mm^2$). For situations requiring extreme security, even fragments of this size are considered to present excess risk so "micro-cut" paper shredders are used that reduce the size of the fragments to generally less than about 2 millimeters on a side as is dictated by the U.S. government CSS 02-01 which calls for a maximum fragment size of 5 $mm^2$ (e.g. 1 mm×5 mm).

SUMMARY OF THE INVENTION

The development of paper shredders that produce different particle sizes has created the problem of deciding what type of paper shredder to purchase since most consumers do not have the space for multiple paper shredders so as to have the optimum type of shredder for a particular job. Ideally, one paper shredder would be able to act as a strip cut, cross-cut and micro-cut shredder. In addition, all types of paper shredders have the potential problem of paper jams. If too many sheets of paper are fed into the unit at one time, the mechanism may be unable to cut through the thickness of multiple sheets and will stall. Virtually all paper shredders will automatically turn off the power when jamming occurs to prevent damage to the unit. In most cases, the jam can be cleared by reversing the shredder and backing the sheets out of the shredding mechanism. Occasionally, the mechanism will be so tightly jammed that it is impossible to reverse the system. In that case if attempting to manually pull the offending papers from the unit fails, the shredding mechanism must be disassembled to achieve repair. In almost all cases this means that the entire shredder must be shipped to a repair location since few ordinary users have either the tools or the skills needed to disassemble and reassemble the shredding mechanism.

This jamming problem is often more severe with certain types of shredding jobs. For example, it may be necessary to shred materials that contain plastics or adhesives. An example would be a pharmacy which is required to shred printed prescription labels that contain confidential patient information. These labels are usually coated with pressure sensitive adhesive. During the shredding process the adhesive gradually accumulates within the shredding mechanism eventually causing it to stall and permanently jam. In such a case reversing the mechanism does no good because reversing the shredder cannot remove the accumulated adhesive from within the mechanism. The only solution is to ship the entire shredder back to the manufacturer for cleaning and repair.

The present invention provides a versatile paper shredder that can deliver both strip cut and cross cut shredding as well as micro-cut shredding. In addition, the improved paper shredder is more easily serviced and repaired. Although the paper shredder housing is typical in external appearance, the device has the mechanical shredding components located in a removable cartridge. When a shredding cartridge is inserted into the paper shredder, it automatically establishes a mechanical linkage with a motor that is concealed inside the paper shredder housing which also carries the typical paper shredder controls. Because the shredding components are located within a removable cartridge, the shredder can be switched from one type of shredder (e.g., a strip shredder) to another type by simply removing one shredding cartridge and replacing it with a second shredding cartridge. If a cartridge becomes hopelessly jammed or otherwise suffers from a mechanical problem, repair is readily achieved by simply replacing the cartridge with no need for a service call or for taking the shredder to a repair facility. The defective shredding cartridge is then returned to the manufacturer to be repaired and refurbished.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide paper shredders having interchangeable shredding cartridges.

Figure 1:
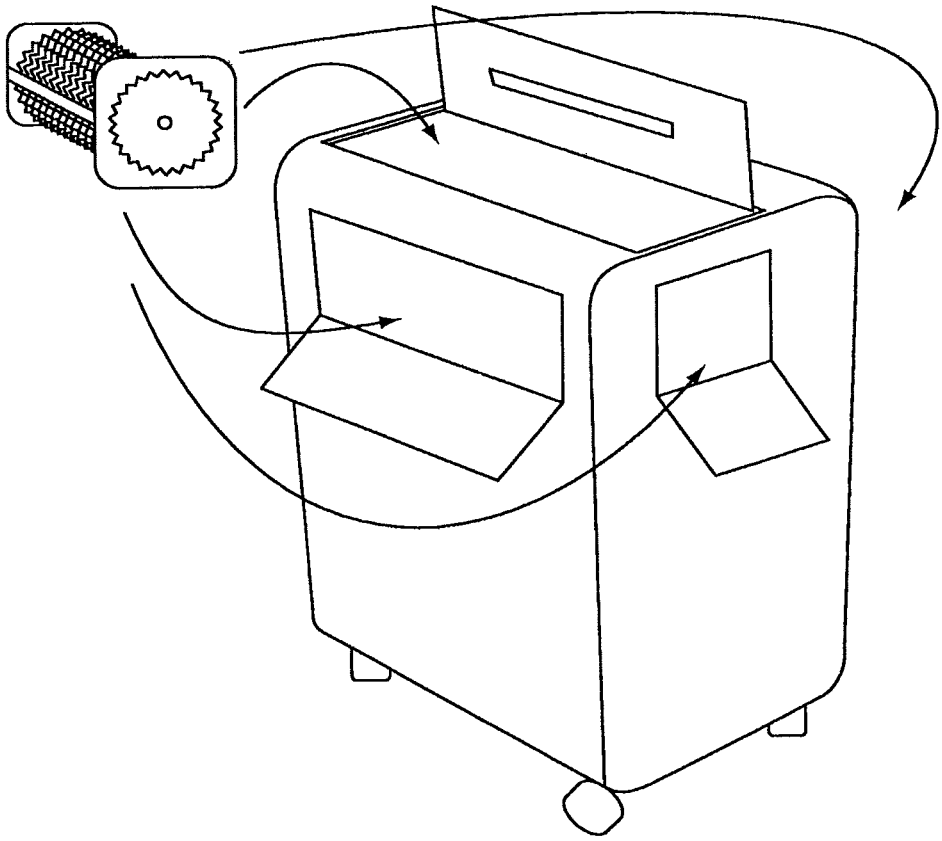
FIG. 1 shows a drawing of a general embodiment of the invention.

The present invention overcomes the problems of purchasing multiple types of shredders and repairing jammed shredders. As shown diagrammatically in FIG. 1 the invention consists of a fairly typical paper shredder in which the shredding mechanism is enclosed in a removable cartridge. If the user wishes to switch from a strip shredder to a cross-cut shredder or a micro-cut shredder, all that is needed is to open a door in the side or top (depending on design) of the shredder housing, remove the existing shredding cartridge and insert a cartridge of the desired type (for example, remove a strip-cut shredding cartridge and replace it with a cross-cut shredding cartridge). This diagram is for ease of understanding; the device could have more than one opening or door for removal and insertion of the cartridge. The "door" does not have to be hinged; for example, a portion of the housing could be removable to allow access to the cartridge after which the portion is replaced on the housing. Similarly, the cartridge could sit flush in a recess in the housing and be permanently accessible (that is, not covered by a door or a portion of the housing). The point is that the shredding mechanism resides in a separate, user removable cartridge and removably couples to a power source in the shredder housing.

If the shredder jams so severely that the jam cannot be cleared by reversing the unit, the system can sometimes be cleared by removing the cartridge and pulling the jammed paper from the cartridge because it is simpler to remove paper from a cartridge than from a traditional shredder because both sides of the shredding mechanism are readily accessible. However, if it proves to be impossible to clear the jam from the cartridge, it is a simple matter to slip in a new cartridge to restore full function to the paper shredder.

In the case of a shredding job that results in inevitable jamming of the shredder such as the shredding of adhesive-coated paper, it is easy to keep a supply of replacement cartridges at hand so that it is quick and simple to swap out a clogged shredding cartridge and swap in a clean and fully functional cartridge. In all these cases the jammed cartridge can be returned to the manufacturer to be refurbished and returned to service. Most likely the cartridge exchange will be made through a local distributor (e.g. an office supply store) where a new cartridge can be purchased with a credit being given for the return of a non-functioning cartridge (which is then returned to the manufacturer for repair).

Although like any machine virtually all parts of a paper shredder are subject to failure, the vast majority of actual failures result from a failure within the shredding mechanism. Thus, the use of interchangeable cartridges is a boon to both the consumer and to the shredder manufacturer because the majority of repair and warranty work can be carried out by merely exchanging the shredding cartridge. This obviates the need to move or ship the entire shredder. For most repairs (either under or out of warranty) the local distributor can act as a depot for supplying the replacement cartridge (for free in the case of a unit under warranty) and for accepting the defective cartridge for recycling purposes. Because the shredding cartridges can usually be refurbished, the quantity of waste shipped to landfills is substantially reduced. Furthermore, because the rest of the shredder fails less often, the number of complete shredders consigned to landfills is also significantly reduced. It's a win-win situation for all parties.

Most conventional paper shredders consist of a housing with an input slot or chute for insertion of items to be shredded, a shredding mechanism below the input slot and a waste storage space or container below the shredding mechanism to accept the shredded fragments. In some cases the waste storage space or waste container is integral with the housing; in other cases the housing is separable from the waste container. The housing also encloses an electric motor that is operationally coupled to the shredding mechanism as well as various switches and electronics to implement reverse mode as well as various safety functions such as automatic shut offs for full waste container ("bin full") and for motor overheating. As shown diagrammatically in FIG. 1, the shredding mechanism of the inventive system generally consists of a series of circular blades spaced apart along a rotating shaft is enclosed in a removable cartridge. This cartridge is constructed so that a gear or similar mechanical coupling engages a complementary coupling when the cartridge is inserted into a paper shredder. The primary difference between a conventional paper shredder and the shredder of the present invention is that the shredding mechanism is enclosed in a removable cartridge as opposed to being permanently coupled to the motor and the enclosure. The other controls and safety functions remain essentially unchanged.

Figure 2:
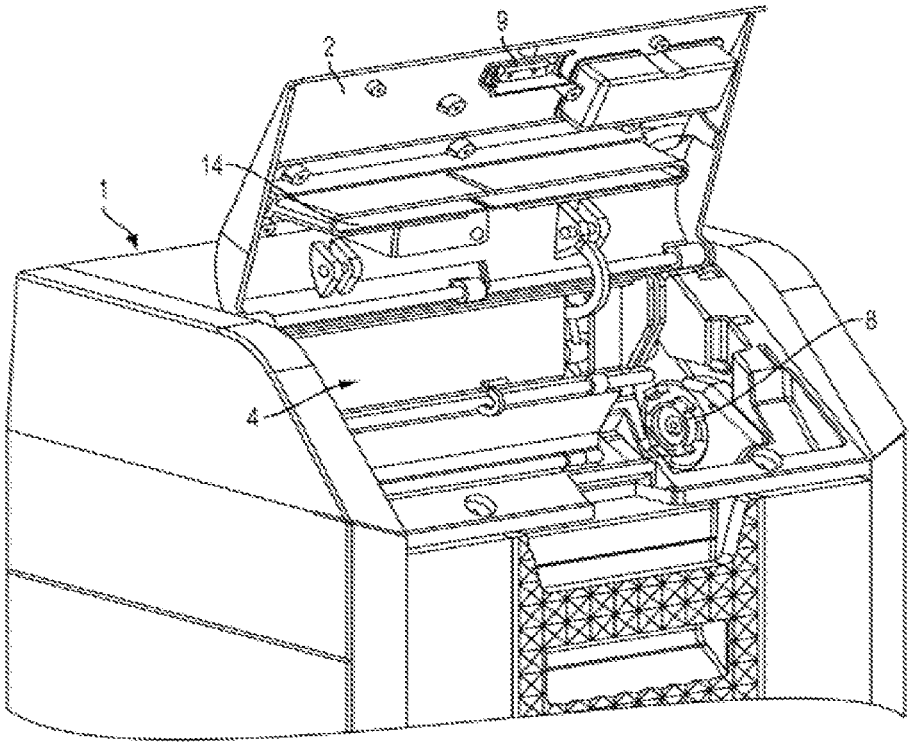
FIG. 2 shows a specific embodiment of the invention using a splined coupling.
Figure 3:
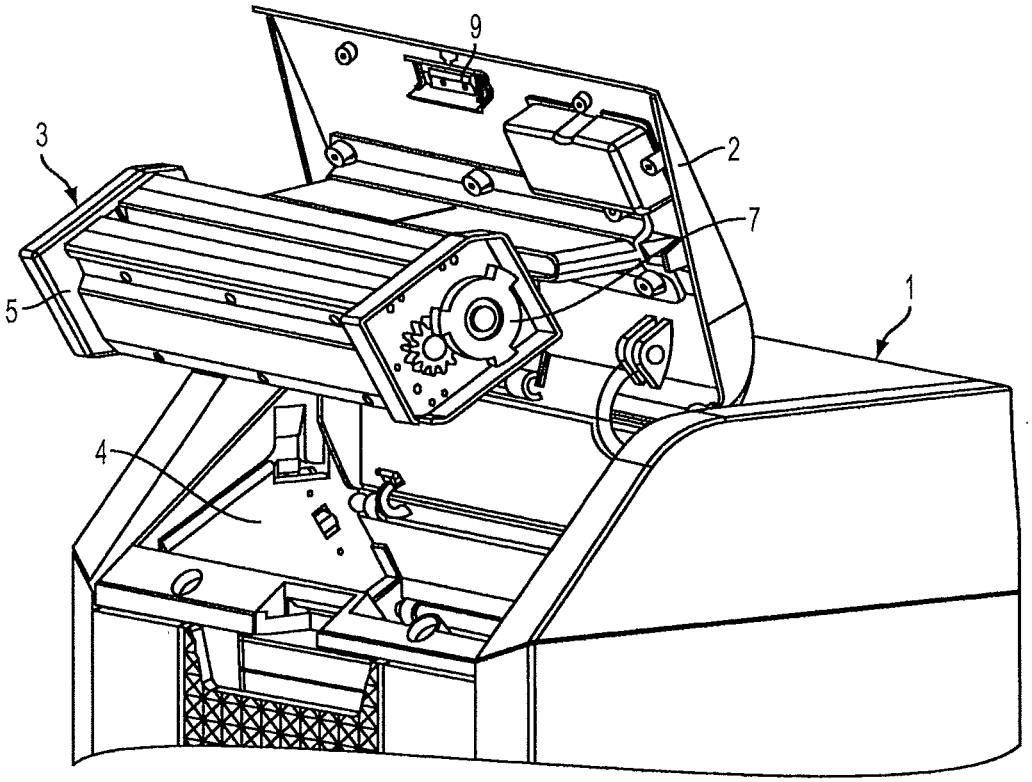
FIG. 3 shows a removable shredding cartridge being inserted into the paper shredder.
Figure 4:
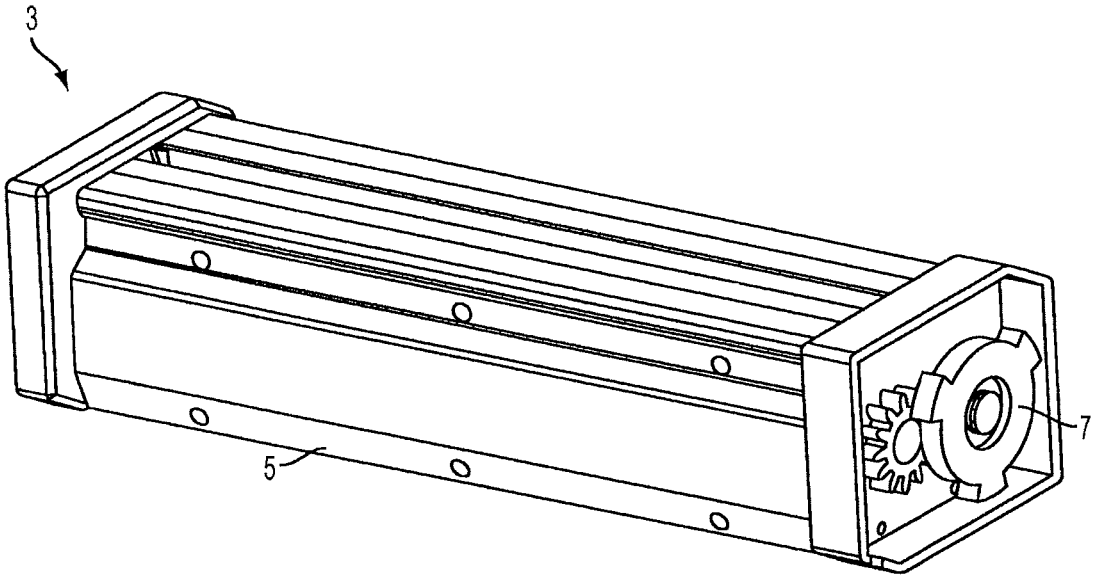
FIG. 4 shows a different view of the removable cartridge shown in FIG. 3.

FIG. 2 shows one embodiment of the invention. The paper shredder 1 has a hinged door 2 attached to its upper surface. The door opens both the upper surface and part of the side surface of the shredder housing. In this drawing the door 2 is open to reveal an interior space 4 with a triple splined coupling 8 at one end. The splined coupling is mechanically driven by an electric motor (not shown) of the type conventionally used in paper shredders. The door 2 has a closure clip 9 that removably interacts with the shredder body to stabilize the door 2 in its closed position. The door 2 also bears a chute 14 that conveys paper to be shredded into the shredding mechanism when the door 2 is closed. FIG. 3 shows a removable shredding cartridge 3 in the process of being inserted into the shredder. When the cartridge 3 is fully inserted into the space 4, the triple splined coupling 7 will mate with the complementary splined coupling 8 to transmit motive force to the cartridge 3. The splined coupling 7 is attached to a first shaft while a second shaft is parallel to the first shaft and mechanically coupled to the first shaft by a gear. When the first shaft is rotated, the second shaft rotates in the opposite direction. FIG. 4 is another view of the cartridge 3 showing an input slot on the upper surface of the frame 5. When the door 2 is closed, the chute 14 delivers paper to be shredded into this input slot.

Figure 5:
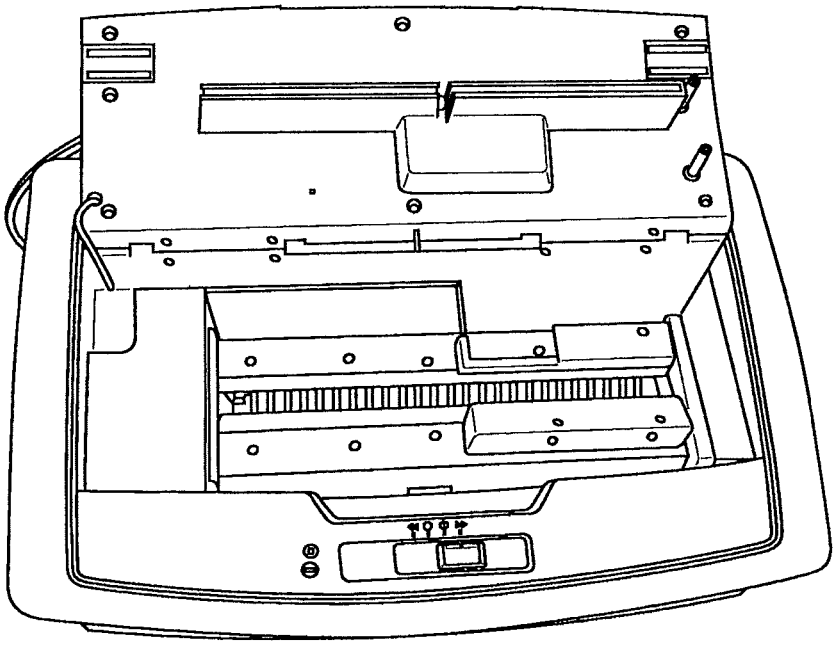
FIG. 5 shows an embodiment where the removable cartridge is inserted in a downwards direction through an opening in the top of a paper shredder.
Figure 6:
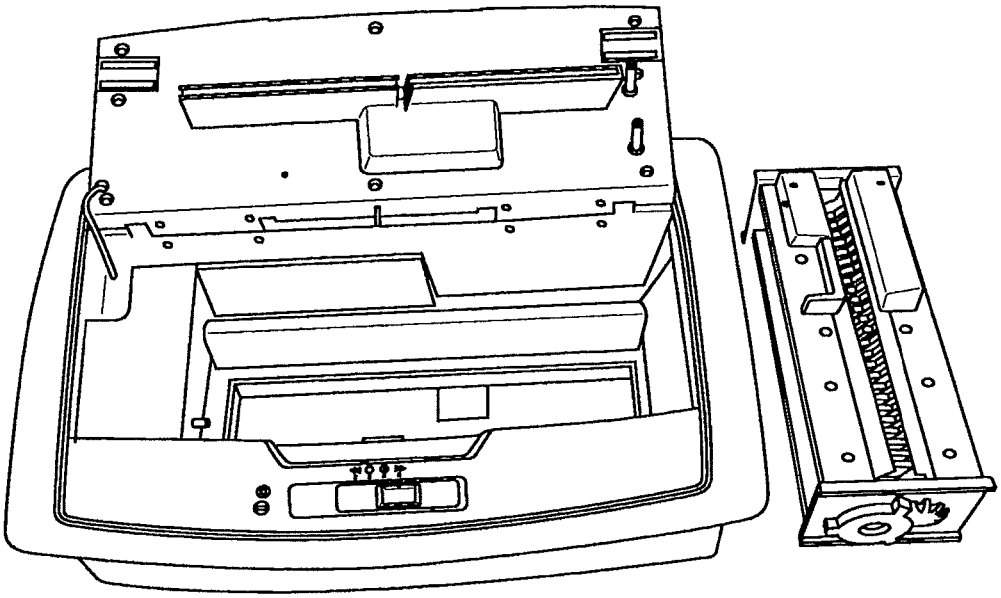
FIG. 6 shows a view of the paper shredder of FIG. 5 without the removable cartridge.
Figure 7:
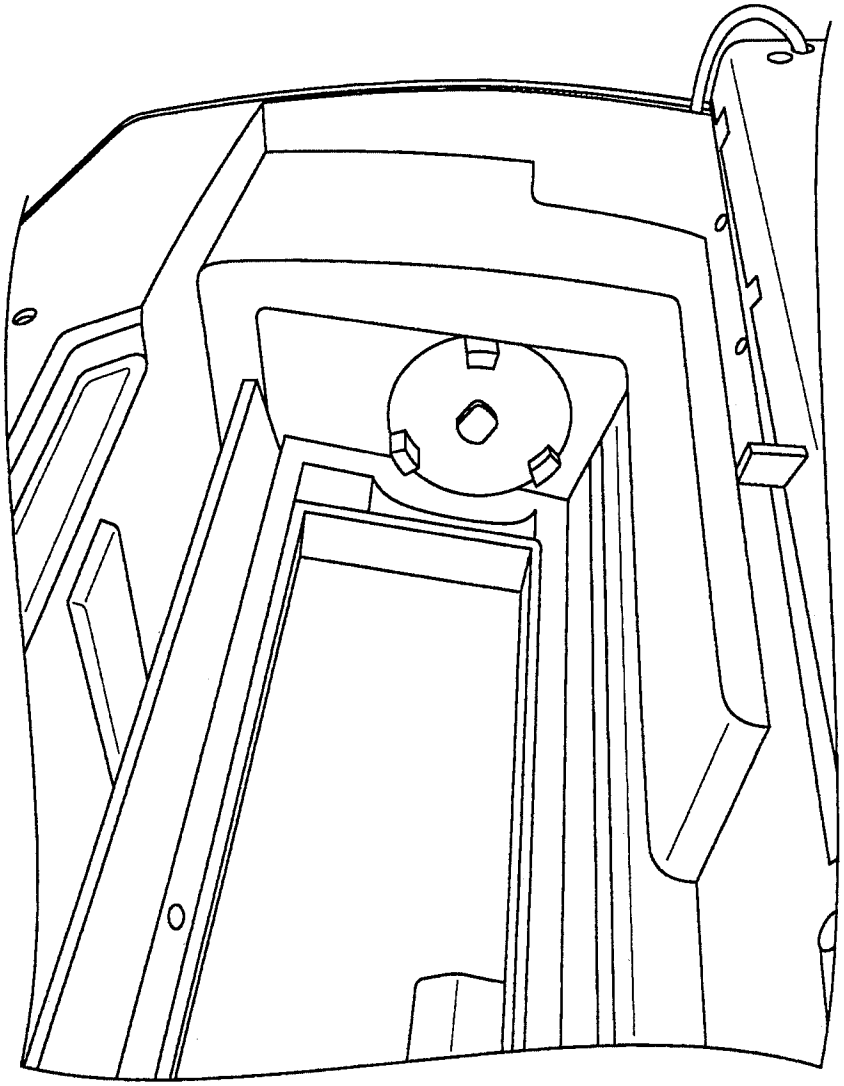
FIG. 7 shows the splined coupling within the housing of a paper shredder.
Figure 8:
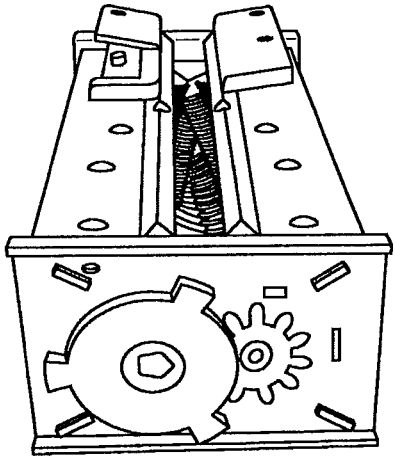
FIG. 8 shows a removable cartridge with a coupling configured to interact with the coupling shown in FIG. 7.
Figure 9:
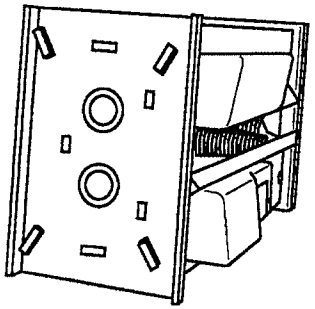
FIG. 9 shows the end opposite the coupling end of the cartridge of FIG. 8.

FIG. 5 shows an alternate embodiment of the inventive system wherein the door opens only the top of the shredder and the cartridge is inserted downwards into the unit. In this view a fully inserted cartridge can be seen. Note the control switch on the upper surface of the mechanism (lower edge in the drawing). FIG. 6 shows the unit with the cartridge removed so the opening through which the shredded paper fragments fall into a storage container can be seen. The cartridge is sitting to the right of the unit showing shredding blades along its upper input slot as well as a triple splined coupling at one end. FIG. 7 shows the mating triple splined coupling within the main housing of the paper shredder. FIG. 8 is a view of the cartridge taken to show the triple splined coupling on one shaft with a parallel mated geared shaft. The view also shows interdigitating spaced apart blades on the two parallel shafts. Finally, FIG. 9 shows the cartridge from the opposite end; the two parallel shafts and their bearings can be easily seen.

As explained above, one object of the current invention is to allow different types of shredding cartridges (e.g. cross-cut versus micro-cut) to be used in the same paper shredder. However, different shredding mechanisms may have different optimal rotation speeds. While it might be possible to alter the shredding mechanism designs so that they all operate optimally at the same speed, it is more advantageous to adjust the motor speed to be optimal for each different cartridge. In addition, modern paper shredders often employ a delay system. When a paper to be shredded is inserted into the input chute, a sensor turns on the shredder motor and the paper is drawn into the shredding mechanism. As soon as the paper clears the sensor, the motor would ordinarily shut off. However, this can leave unshredded material in the mechanism which can contribute to jamming. Therefore, a delay mechanism normally keeps the power on to the motor for a sufficiently time for all material to exit the shredding mechanism. Each different type of shredding mechanism has a different optimal delay.

Therefore, the system preferably employs a keying system so that the motor and other responses of the system (delays, etc.) are automatically adjusted for each cartridge when the cartridge is inserted. The keying system can be partly mechanical or fully electronic. In one embodiment the cartridge has a series of protrusions (tabs, bumps, etc.) that form an identifying pattern. When the cartridge is inserted into the shredder body, these protrusions interact with a number of sensors so that the identifying code of the cartridge can be read by the system. Alternately, this code can be optically encoded on the cartridge (e.g. a bar code) with the code being optically read when the cartridge is inserted. The shredder responds by setting the motor speed and other response factors according to this code. One manner of achieving this adjustment is for a microcontroller embedded in the shredder to contain a lookup table which lists all the adjustment parameters for each type of cartridge. If the number of adjustment parameters is small, they can be directly contained in the identifying code; that is, the code directly specifies motor speed and stop/start delay periods, etc. The advantage of this approach is that a newly designed cartridge can be inserted into shredders that were built prior to the new cartridge design. If a simple lookup table were employed, older shredders could not accept the new cartridges unless the shredder's software was updated to include the new identifying codes in the lookup table. A still more flexible approach that allows adjustment of an essentially unlimited range of operational parameters is to include a small memory chip in the cartridge. When the cartridge is inserted the chip makes contact with the system and transfers all of the needed information on speed and delays, etc. to the shredders microcontroller. In this way even radically redesigned shredder cartridges can be used in older shredders.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A paper shredder system comprising:

a shredder housing including an interior space;

a first mechanical coupling exposed within the interior space; and a user removable, interchangeable shredding cartridge disposed within the interior space comprising:

a frame; and a second mechanical coupling, complementary to the first mechanical coupling, linked to a shredding mechanism within the shredding cartridge, releasably engaging the first mechanical coupling and automatically disengaging the first mechanical coupling when the shredding cartridge is removed from the interior space by a user, whereby the shredding cartridge is interchangeable from shredder housing to shredder housing.

2. The paper shredder system according to claim 1 further comprising a cover disposed to close the interior space.

3. The paper shredder system according to claim 2, wherein the cover further comprises a chute which delivers paper to be shredded to said shredding cartridge.

4. The paper shredder system according to claim 1, wherein the first and second mechanical couplings engage each other by means of a triple splined mechanism.

* * * * *